United States Patent [19]

Estvold

[11] Patent Number: 4,770,379

[45] Date of Patent: Sep. 13, 1988

[54] DISPOSABLE TOOTHBRUSH HOLDER

[76] Inventor: Terry L. Estvold, 46 Mt. Vernon Cir., Dunwoody, Ga. 30338

[21] Appl. No.: 57,113

[22] Filed: Jun. 3, 1987

[51] Int. Cl.[4] ..... A46B 17/02

[52] U.S. Cl. ..... 248/110; 211/65; 248/174

[58] Field of Search ..... 248/174, 110, 111, 459; 211/13, 65, 60.1; 40/120, 124.1; 206/45.21, 45.22, 45.24, 45.26, 45.27

[56] References Cited

U.S. PATENT DOCUMENTS

| | | | |
|---|---|---|---|
| 735,486 | 8/1903 | Fels | 40/124.1 |
| 746,540 | 12/1903 | Luhe et al. | 40/120 |
| 873,421 | 12/1907 | Fleming . | |
| 893,355 | 7/1908 | McIntyre . | |
| 1,117,824 | 11/1914 | Fleming . | |
| 1,647,154 | 11/1927 | Soybel . | |
| 1,821,025 | 9/1931 | Ohlson | 40/124.1 |
| 2,125,784 | 8/1938 | Higgins | 248/109 |
| 2,299,829 | 10/1942 | Feddersen | 248/174 |
| 2,449,530 | 9/1948 | Lambert | 248/174 |
| 2,902,145 | 9/1959 | Wagner | 211/65 X |
| 2,975,905 | 3/1961 | Foland | 40/124.1 X |
| 3,198,339 | 8/1965 | Stolarz | 211/49 |
| 3,233,743 | 2/1966 | Tirro | 211/65 |
| 3,281,975 | 11/1966 | Simone | 40/120 |
| 3,344,930 | 10/1967 | Merkel | 211/65 |
| 4,002,237 | 1/1977 | Nichols | 248/459 X |

*Primary Examiner*—J. Franklin Foss

*Attorney, Agent, or Firm*—Thomas & Kennedy

[57] ABSTRACT

Toothbrush holder 10 is formed from a single piece of sheet material and is easily folded along its fold lines 14, 18, 19, 28 and 29 into an isosolese triangular shape, with toothbrush openings 23 and 24 formed across the apex fold line 14. The toothbrushes 29 are inserted downwardly through the openings 23 and 24 and are supported in an upright attitude suitable for drying.

4 Claims, 1 Drawing Sheet

DISPOSABLE TOOTHBRUSH HOLDER

BACKGROUND OF THE INVENTION

The invention disclosed herein relates in general to toothbrush holders, whereby the toothbrush is held in an upstanding attitude with its brush bristles exposed to the air. More particularly, the invention comprises a disposable toothbrush holder which is made from folded cardstock and is so inexpensive to construct that it is disposable after only one use, and is suitable for use as a disposable item in a hotel room for use by the overnight guest, and is of suitable size and shape to bear the name of a hotel or bear other advertisements.

Generally, a person likes to store his or her toothbrush in a sanitary environment where no other objects are likely to contact the toothbrush, and in a situation where a wet toothbrush is capable of rapid drying. When a hotel guest or hospital patient has brushed his or her teeth, usually there is no suitable location where the toothbrush can be stored for drying. The guest is reluctant to place the toothbrush on the counter or on the sink, and usually no other means is provided for supporting the toothbrush in a vertical attitude for rapid drying.

SUMMARY OF THE INVENTION

Briefly described, the present invention comprises a disposable toothbrush holder suitable for use in hotels and other lodging facilities, whereby one or more toothbrushes can be held in a clean holder with the bristles of the brush exposed for drying. The holder is fabricated from folded sheet material, such as relatively thin cardstock or thick paper, with the holder formed in an upright triangular shape with one or more openings at the apex of the triangular shape for receiving one or more toothbrushes. The design of the card material is very simple, comprising a rectangular card formed with fold lines that enable the hotel room attendant to easily and rapidly fold the card into the appropriate triangular configuration. One or more rectangular toothbrush receiving openings are formed at the apex of the triangular holder, and the handle of a toothbrush is inserted down through an opening until the end of the handle of the toothbrush engages the bottom of the triangular holder or the bristles of the brush of a short toothbrush engage the opening through which the handle is inserted, so that the bristles of the toothbrush are always supported in a situation where they are exposed to the air for drying purposes.

The upwardly sloped sides of the triangular shaped holder are flexible, and the holes formed in the apex of the holder extend a short distance downwardly into the side walls of the holder. With this arrangement, the brush handle can be wedged through the opening in the apex of the holder, causing the side walls to spread slightly as the handle is being urged into the opening, if necessary. Further, the openings of the toothbrush holder are of rectangular shape and the flat edges of the openings usually engage the relatively flat side surfaces of the conventional toothbrush and tend to hold the toothbrush with its bristles facing forwardly or rearwardly with respect to the toothbrush holder. The relatively flat front and rear panels of the holder are sloped upwardly to an apex of the triangular holder and provide a desirable surface on which an advertisement can be displayed to the occupant of the hotel room.

Thus, it is an object of this invention to provide a disposable toothbrush holder for conveniently storing one or more toothbrushes in an upright attitude in a sanitary condition, with the bristles of the brush exposed for drying.

Another object of this invention is to provide a disposable toothbrush holder for one time use in hotels and other lodging facilities which is easy to assemble by the room attendant and which can be used for displaying advertisements of the hotel, etc.

Other objects, features and advantages of this invention will become apparent upon reading the following specification, when taken in conjunction with the accompanying drawings.

DETAILED DESCRIPTION

Figure 1:
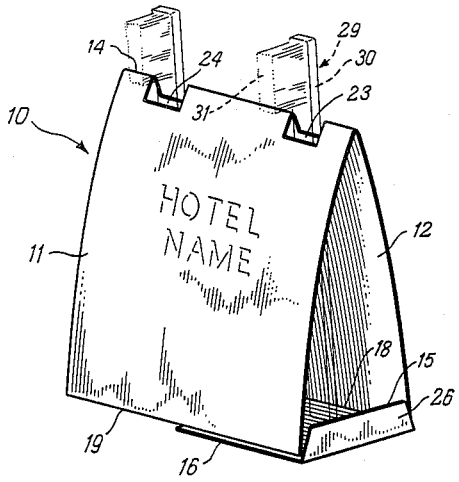
FIG. 1 is a perspective view of the toothbrush holder, showing the front and one end portion thereof, and showing toothbrushes in dashed lines.
Figure 2:
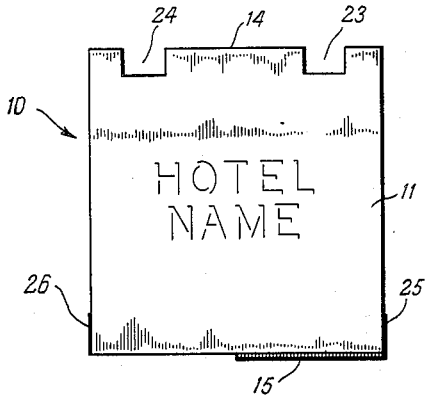
FIG. 2 is a side elevational view thereof.
Figure 3:
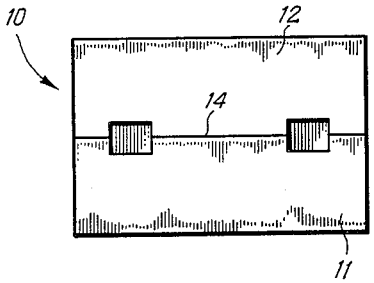
FIG. 3 is a top view thereof.
Figure 4:
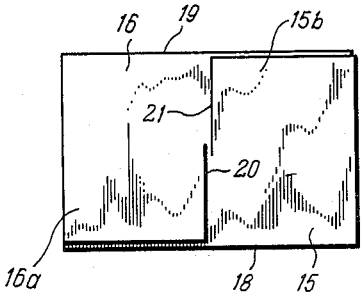
FIG. 4 is a bottom view thereof.
Figure 5:
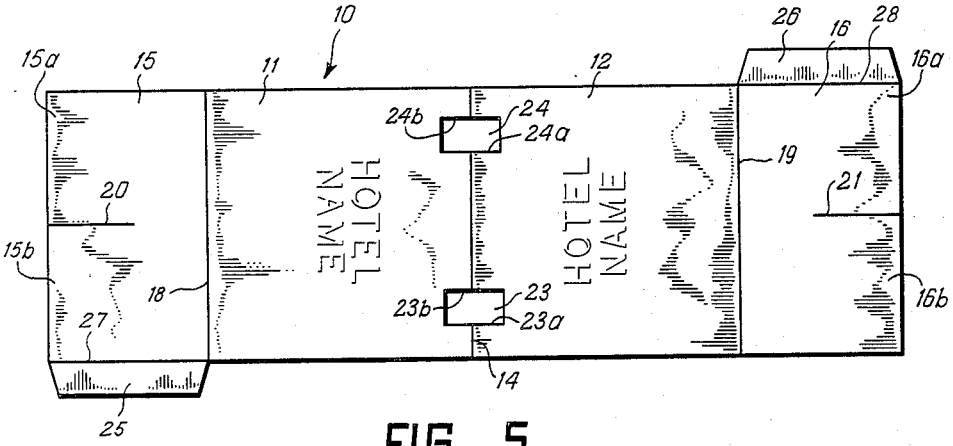
FIG. 5 illustrates the toothbrush holder in a laid-out, flat configuration, with the card material being unfolded.

Referring now in more detail to the drawings, in which like numerals indicate like parts throughout the several views, FIG. 1 shows the toothbrush holder 10 which comprises upwardly sloped side walls 11 and 12 folded along a fold line 14, and bottom panels 15 and 16 which are folded along lower fold lines 18 and 19 and which are split and interleaved together to retain the shape of the holder. As illustrated in FIG. 5, the bottom panels 15 and 16 are partially split by cuts 20 and 21. Rectangular toothbrush openings 23 and 24 are formed at the upper fold line 14, with the rectangular openings 23 and 24 being spaced apart from one another and extending on both sides of the fold line 14 into the side walls 11 and 12. The rectangular openings 23 and 24 have long parallel edges 23*a*, 23*b*, 24*a* and 24*b* extending at right angles to the fold line 14, and have short parallel edges 23*c*, 23*d*, 2*c* and 24*d* extending parallel to the fold line 14.

Bottom panels 15 and 16 further include side tabs 25 and 26, respectively, with one side tab 26 extending from one side of the holder and with the other side tab extending from the other side of the holder. The side tabs 25 and 26 are separated from bottom panels 15 and 16 by fold lines 27 and 28.

The toothbrush holders normally will be packaged and shipped in a flat configuration as illustrated in FIG. 5, with many of the toothbrush holders packaged in a single package. When received at the location of use, a hotel, etc., the room attendant will open a package of toothbrush holders and will assemble a holder from the flat configuration of FIG. 5 into the formed configuration of FIG. 1. The attendant typically will fold the toothbrush holder along its fold lines 14, 18, 19, 27 and 28 into the triangular configuration of FIG. 1, and will interleave the bottom panels 15 and 16, by placing bottom panel half 15*a* on top of bottom panel half 16*a*, and by placing bottom panel half 16*b* on top of bottom panel half 15*b*. This interleaving of the bottom panels together tends to frictionally maintain the toothbrush holder in its triangular configuration.

In addition, the side tabs 25 and 26 are folded along their respective fold lines 27 and 28 to an upright attitute.

When the occupant of the hotel room has brushed his or her teeth, the handle 30 of a toothbrush 29 can be inserted downwardly through one of the toothbrush openings 23 or 24. Typically, the toothbrush handle 30 will be long enough so that the distal end of the handle will engage a bottom panel 15 or 16. The handle is prevented from moving laterally out of the confines of the toothbrush holder by the side tabs 25 and 26 so that the bristles will not come in contact with the holder. The open sides of the toothbrush holder allow for the hygienic drying of the handle, by allowing moisture to evaporate rapidly from the handle of the brush and from the bottom panels of the holder.

Since the effective cross-sectional dimension of the toothbrush openings 23 and 24 become smaller when the side walls 11 and 12 are folded along the fold line 14, it may be necessary to slightly wedge the toothbrush handle 30 into an opening 23 or 24. The side walls 11 and 12 will spread apart slightly to accomodate this wedging action, and the tendency of the side walls to resume their original folded shape tends to apply slight frictional force to the toothbrush handle so as to apply a slight gripping force to the handle. Thus, is the user of the holder desires to leave the bristles 31 of the toothbrush slightly elevated above the toothbrush holder, this slight frictional engagement will permit this.

The generally open shape of the toothbrush holder permits not only the bristles of the brush to be positioned above the holder and exposed for drying, but also permits the handle located within the sloped side walls 11 and 12 to be ventilated for drying.

When the supply of toothbrush holders is ordered by the hotel, the name of the hotel can be printed on the outside surface of the sloped side walls 11 and 12, together with other information such as telephone numbers, addresses, etc. Further, the entire device is reversible so that certain advertisements can be placed on one side of each sloped side wall 11 and 12, and different advertisements can be placed on the reverse sides of the side walls 11 and 12, and the room attendants can be instructed as to which advertisements should confront the occupant of the room. For example, if the business activity at the hotel restaurant is low, the cards can be printed with an advertisement of the restaurant on one panel 11 or 12 and the room attendants instructed to fold the cards to expose that particular advertisement.

It should be understood that the embodiments of the invention disclosed herein illustrate principles of the invention in a preferred form. Other modifications, additions and deletions may be made thereto without departure from the spirit and scope of the invention as set forth in the following claims.

I claim:

1. A disposable toothbrush holder formed of a single flat sheet of material is folded into an upstanding triangular shape, including an upwardly extending front panel having an upper edge portion and a lower edge portion, an upwardly extending back panel having an upper edge portion and a lower edge portion with its upper edge portion joined at an apex fold line to the upper edge portion of said front panel, and at least one toothbrush opening formed in the upper edge portions of said front and rear panels, with said toothbrush opening extending across said fold line for receiving the handle of a toothbrush, said toothbrush opening being of a width that approximately corresponds to the width of a toothbrush handle and of a length greater than the thickness of the toothbrush handle and when the sheet material is folded into its triangular shape the toothbrush opening has an effective length less than the thickness of the toothbrush handle so that the edges of the opening frictionally engage the toothbrush handle.

2. The disposable toothbrush holder of claim 1 wherein said sheet material is substantially rectangular and comprises four panels formed by three parallel fold lines including a centrally positioned fold forming said apex fold line and side fold lines equally spaced from and on opposite side of said apex fold line and forming bottom panels that fold inwardly of said holder, said bottom panels being split at their edges and the split portions of each bottom panel being interleaved with the split portions of the other panel, whereby the flat sheet of material can be folded with either surface facing outwardly.

3. The disposable toothbrush holder of claim 2 and wherein said bottom panels further include side tabs formed by fold lines extending at right angles to said apex fold line whereby said bottom panels tend to remain flat in response to the right angle tabs, and said front and back panels are free to bow outwardly to receive the handle of a toothbrush.

4. A disposable toothbrush holder formed from a single sheet of material is folded into an upstanding triangular shape, said sheet including an apex fold line, and side fold lines approximately equally positioned on opposite sides of said apex fold line to form front and rear panels on opposite sides of said apex fold line and bottom panels beyond the side fold lines, said sheet of material folded along its fold lines and said bottom panels being arranged in overlying relationship to hold said sheet of material in an upstanding triangular shape, at least one elongated toothbrush opening formed in said side panels and with its length extending across said apex fold line, and side tabs extending laterally from said bottom panels and folded upwardly at opposite sides of the toothbrush holder, said toothbrush opening being of a width that approximately corresponds to the width of a toothbrush handle and of a length greater than the thickness of the toothbrush handle and when the sheet of material is folded into its triangular shape the toothbrush opening has an effective length less than the thickness of the toothbrush handle so that the edges of the opening tend to grip the toothbrush handle.

* * * * *